US007296635B2

(12) United States Patent
Droste

(10) Patent No.: US 7,296,635 B2
(45) Date of Patent: Nov. 20, 2007

(54) ROTARY HAMMER WITH MODE CHANGE RING

(75) Inventor: Manfred Droste, Limburg-Offeim (DE)

(73) Assignee: Black & Decker Inc., Newark, DE (US)

( * ) Notice: Subject to any disclaimer, the term of this patent is extended or adjusted under 35 U.S.C. 154(b) by 694 days.

(21) Appl. No.: 10/603,371

(22) Filed: Jun. 25, 2003

(65) Prior Publication Data

US 2006/0266535 A1 Nov. 30, 2006

(30) Foreign Application Priority Data

Jun. 26, 2002 (GB) ..... 0214772.6

(51) Int. Cl.
*E02D 7/02* (2006.01)

(52) U.S. Cl. ..... 173/48; 173/104

(58) Field of Classification Search ..... 173/48, 173/47, 109, 104, 216–217
See application file for complete search history.

(56) References Cited

U.S. PATENT DOCUMENTS

| | | | | |
|---|---|---|---|---|
| 4,529,044 | A | 7/1985 | Klueber et al. | |
| 4,719,976 | A | 1/1988 | Bleicher et al. | |
| 4,732,217 | A | 3/1988 | Bleicher et al. | |
| 4,895,212 | A | 1/1990 | Wache | |
| 4,998,588 | A | 3/1991 | Manschitz | |
| 5,056,607 | A | 10/1991 | Sanders | |
| 5,277,259 | A | 1/1994 | Schmid et al. | |
| 5,320,177 | A | 6/1994 | Shibata et al. | |
| 5,337,835 | A | 8/1994 | Bohne et al. | |
| 5,373,905 | A | 12/1994 | Bleicher et al. | |
| 5,379,848 | A | 1/1995 | Rauser | |
| 5,456,324 | A | 10/1995 | Takagi et al. | |
| 5,842,527 | A | 12/1998 | Arakawa et al. | |
| 6,035,945 | A | 3/2000 | Ichijyou et al. | |
| 6,109,364 | A * | 8/2000 | Demuth et al. | 173/48 |
| 6,142,242 | A | 11/2000 | Okumura et al. | |
| 6,176,321 | B1 | 1/2001 | Arakawa et al. | |
| 6,192,996 | B1 | 2/2001 | Sakaguchi et al. | |
| 6,460,627 | B1 * | 10/2002 | Below et al. | 173/48 |
| 6,478,095 | B2 | 11/2002 | Neumaier | |

(Continued)

FOREIGN PATENT DOCUMENTS

| | | |
|---|---|---|
| DE | 3213672 | 10/1983 |
| EP | 1101570 | 5/2001 |
| GB | 2170746 | 8/1996 |

*Primary Examiner*—Rinaldi I. Rada
*Assistant Examiner*—Lindsay Low
(74) *Attorney, Agent, or Firm*—Michael P. Leary; Charles Yocum; Adan Ayala

(57) ABSTRACT

An electrically hammer comprising a hollow spindle, a piston, and an intermediate shaft. A wobble drive arrangement includes a wobble sleeve rotatably mounted on the intermediate shaft. A mode change element is selectively engageable, by movement along the intermediate shaft, with a set of drive teeth provided on the intermediate shaft and a set of driven teeth provided on the wobble sleeve. When the mode change element is engaged with both sets of teeth it transmits rotary drive from the intermediate shaft to the wobble sleeve so that the wobble sleeve arrangement reciprocatingly drives the piston. A mode change ring is formed integrally with an axial stop surface and the axial stop surface is engageable with a cooperating end stop surface formed integrally with one of the intermediate shaft and the wobble sleeve to limit the movement of the mode change element along the intermediate shaft.

18 Claims, 3 Drawing Sheets

U.S. PATENT DOCUMENTS 6,510,903 B2 1/2003 Funfer
6,557,648 B2 5/2003 Ichijyou et al.
6,971,455 B2 * 12/2005 Shibata et al. ..... 173/48
7,070,008 B2 * 7/2006 Baumann et al. ..... 173/48
7,073,605 B2 * 7/2006 Saito et al. ..... 173/48
2002/0088627 A1 7/2002 Plietsch
2002/0125020 A1 9/2002 Funfer

* cited by examiner

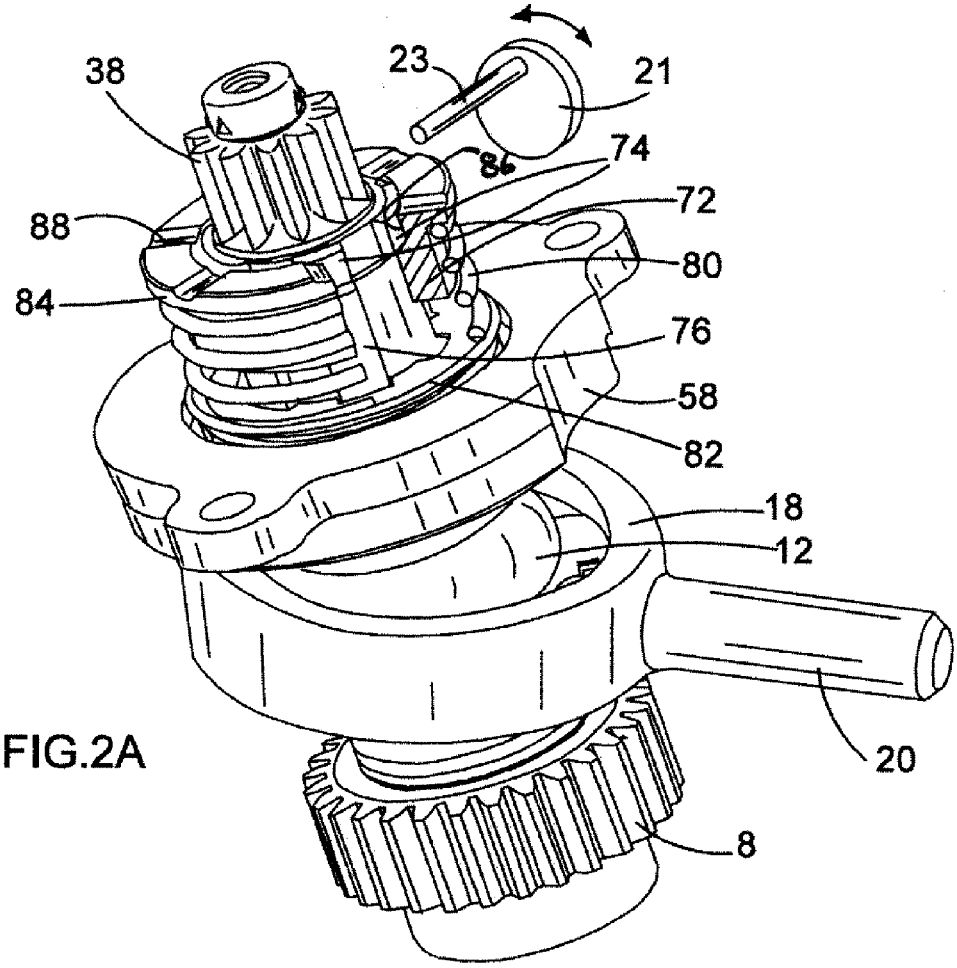
FIG.2A
FIG.2B
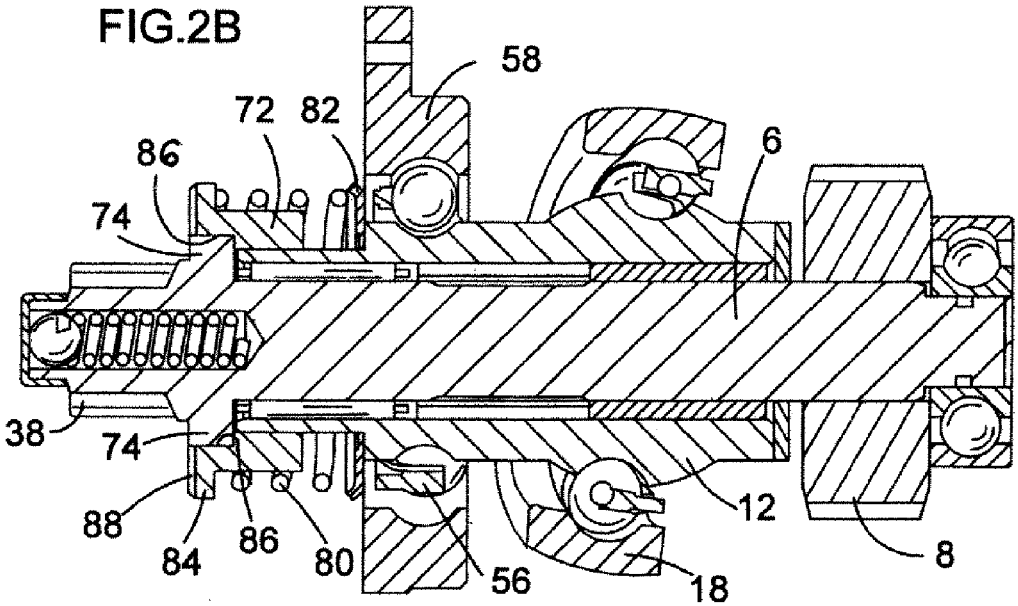

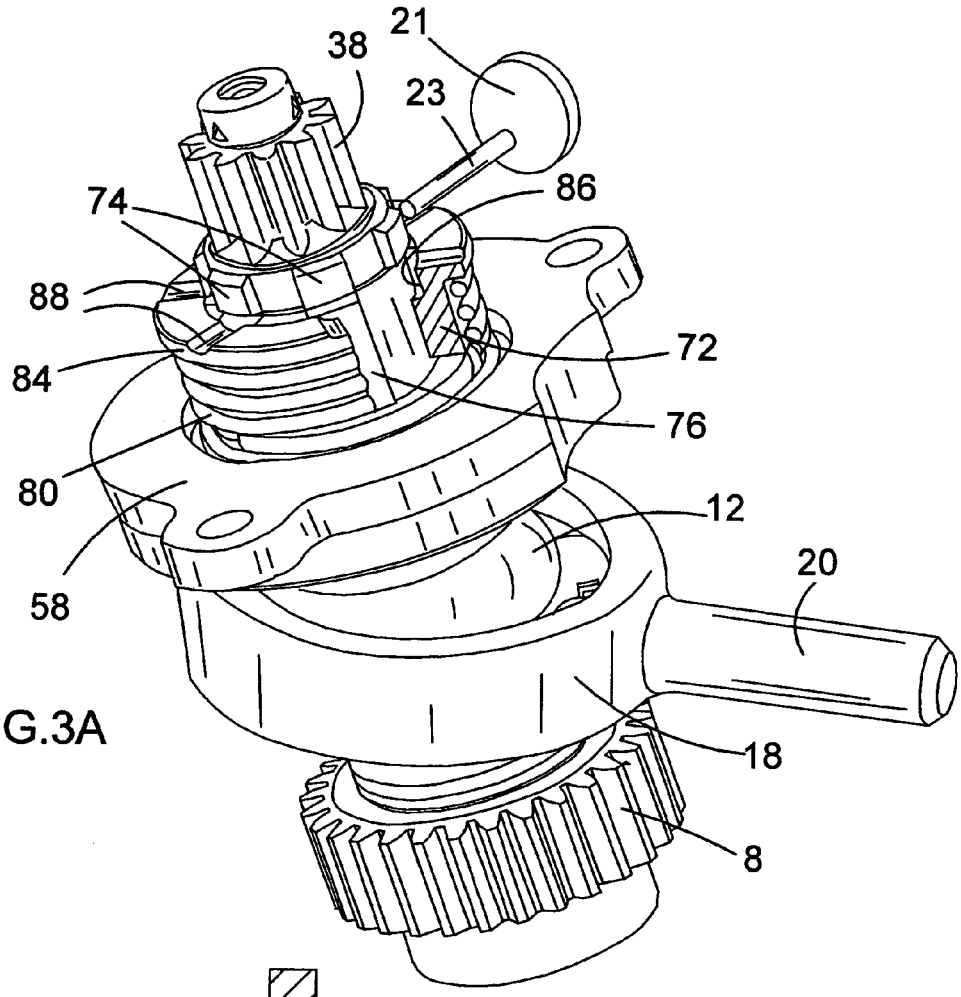
FIG.3A
FIG.3B
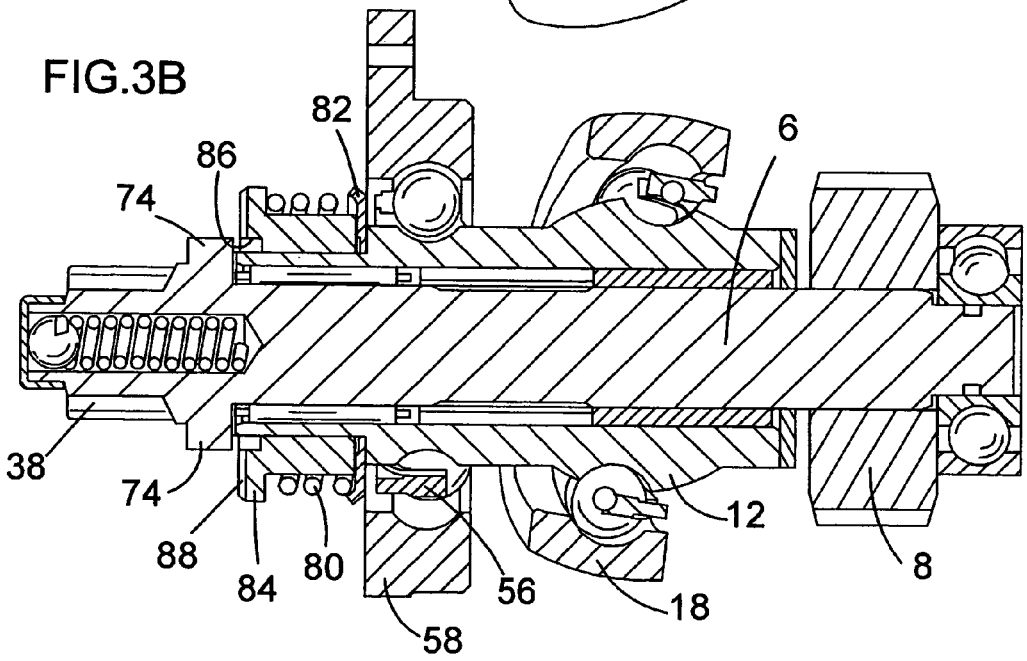

ROTARY HAMMER WITH MODE CHANGE RING

BACKGROUND OF THE INVENTION

This invention relates to electric hammers, in particular rotary hammers, having an air cushion hammering mechanism.

Such hammers will normally have a housing and a hollow cylindrical spindle mounted in the housing. The spindle allows insertion of the shank of a tool or bit, for example a drill bit or a chisel bit, into the front end thereof so that it is retained in the front end of the spindle with a degree of axial movement. The spindle may be a single cylindrical part or may be made of two or more co-axial cylindrical parts, which together form the hammer spindle. For example, a front part of the spindle may be formed as a separate tool holder body for retaining the tool or bit. Such hammers are provided with an impact mechanism which converts the rotational drive from an electric motor to a reciprocating drive causing a piston, which may be a hollow piston, to reciprocate within the spindle. The piston reciprocatingly drives a ram by means of a closed air cushion located between the piston and the ram. The impacts from the ram are transmitted to the tool or bit of the hammer, optionally via a beatpiece.

Such hammers can also be employed in combination impact and drilling mode or in a drilling only mode in which the spindle, or a forwardmost part of the spindle, and hence the bit inserted therein will be caused to rotate. In the combination impact and drilling mode the bit will be caused to rotate at the same time as the bit receives repeated impacts. A rotary drive mechanism transmits rotary drive from the electric motor to the spindle to cause the spindle, or a forwardmost part thereof to rotate.

In smaller hammers, a wobble drive arrangement is generally used to convert a rotary drive from the motor to the reciprocating drive of the piston. In a known arrangement the rotary drive from the motor is transmitted to an intermediate shaft mounted within the hammer housing generally parallel to the axis of the spindle. A wobble sleeve is rotatably mounted on the intermediate shaft. The wobble sleeve is formed with a wobble race which extends around the wobble sleeve at an oblique angle to the axis of the intermediate shaft. Balls are set to run between this inner race and an outer race of a wobble ring, which wobble ring has a wobble pin extending from it to the rearward end of the piston. The wobble pin is pivotally connected to the rearward end of the piston via a trunnion arrangement. Thus, when the wobble sleeve is rotatably driven the wobble pin reciprocates and reciprocatingly drives the piston within the spindle and hammering occurs. In drilling only mode hammering is not required and so a mode change mechanism is required to selectively transmit the rotation of the intermediate shaft to the wobble sleeve.

It is known to have a mode change element moveable along the intermediate shaft in a first direction in order to be engaged with sets of teeth on the wobble sleeve and the intermediate shaft to actuate hammering or in a second opposite direction in order to be disengaged with one of the sets of teeth to disable hammering. The mode change element generally requires some means of determining its end positions on the intermediate shaft. This is generally provided by an axial stop element mounted on the intermediate shaft or the wobble sleeve using a circlip. Such axial stops and circlips are difficult to assemble, if they are not assembled correctly the hammer will not operate correctly and if they become loose, then they can damage other components of the hammer. Alternatively, a mode change linkage, connected to a mode change knob or the mode change knob itself, which act to move the mode change element between its different positions can be used to determine the end positions of the mode change element. However, this may reduce the accuracy with which the end positions can be determined and so may lead to a less compact design.

In smaller hammers, where the compactness of the hammer is a critical design issue, the mode change mechanism must be compact. However, the mode change mechanism must also be robust so that it can operate reliably in the high vibration environment of a hammer.

SUMMARY OF INVENTION

The present invention aims to provide a rotary hammer arrangement with a compact and robust mode change mechanism for selectively actuating hammering.

According to the present invention there is provided an electrically powered hammer comprising:

a hammering mechanism for generating repeated impacts on a tool or bit of the hammer;

a rotatingly driven intermediate shaft;

a wobble drive arrangement for reciprocatingly driving the hammering mechanism, which wobble drive arrangement includes a wobble sleeve mounted on the intermediate shaft; and a mode change element selectively engageable, by movement along the intermediate shaft, with a set of driving teeth provided on the intermediate shaft and a set of driven teeth provided on the wobble sleeve, such that when the mode change element is engaged with both sets of teeth it transmits rotary drive from the intermediate shaft to the wobble sleeve;

characterized in that the mode change element is formed integrally with at least one axial stop surface and the or each axial stop surface is engageable with a cooperating end stop surface formed integrally with one of the intermediate shaft and the wobble sleeve to limit the movement of the mode change element along the intermediate shaft.

The end stops for the mode change ring are provided by existing components, namely the mode change ring itself and the wobble sleeve and/or the intermediate shaft. This results in a reduction in the number of components required, which improves the compactness and ease of assembly of the hammer. Also, integrating the end stops into pre-existing and themselves robust components leads to a robust design of end stop.

The or each axial stop surface may engage with a cooperating end stop surface when the mode change element engages both sets of teeth. The mode change element may be moved in a first direction along the intermediate shaft to engage both sets of teeth so that the cooperation of the or each axial stop surface and cooperating end stop surface limits the movement of the mode change element further along the intermediate shaft in the first direction. This provides an end stop for the movement of the mode change element into its position where hammering occurs.

In a preferred embodiment the cooperating end stop surfaces are formed by one or more end faces of one of the sets of teeth. This means that additional end stop surfaces need not be provided on the intermediate shaft or the wobble sleeve.

The or each axial stop surface may be formed by an end surface of one or more recesses which recesses extend axially with respect to the longitudinal axis of the intermediate shaft and are formed in a face of the mode change element facing towards the intermediate shaft.

Preferably, the mode change element is non-rotatably and axially slideable mounted on one of the sets of teeth. The mode change element then needs only to be moved axially into engagement with the other of the sets of teeth to engage both sets and transmit rotary drive from the intermediate shaft to the wobble sleeve.

In a preferred embodiment a spring member biases the mode change element into the position in which is engages both sets of teeth. This means that any mode change linkage or mode change knob needs only to move the mode change element in one direction, against the biasing force of the spring. This can simplify the design of mode change linkage or knob, which can increase the compactness of the overall design of mode change mechanism.

The spring member may extend between a flange formed on the mode change element and a bearing ring for rotatably supporting the intermediate shaft in the housing. The bearing ring may form the outer race for a set of balls which run between the outer race and an inner race formed in an external surface of the wobble sleeve. A washer may advantageously by mounted within the bearing ring so that the spring member bears against the washer to prevent wear of the bearing ring. Where a set of balls which run in the bearing ring are held in a cage, the washer may be mounted between the cage and the spring member so that it protects the generally plastic cage from an end of the generally metal helical spring.

For increased compactness and to provide a robust design, the mode change element may be formed as a ring, or alternatively as a part of a ring. The mode change element can then be mounted co-axially with the intermediate shaft.

The mode change element may be non-rotatably and axially slideably mounted on the intermediate shaft drive teeth or it may be non-rotatably and axially slideably mounted on the wobble sleeve driven teeth. Then the or each axial stop surface of the mode change element may engage with a cooperating end stop formed on the wobble sleeve or intermediate shaft, respectively.

Where the mode change element is mounted on the wobble sleeve driven teeth, the mode change element may be biased by a spring member towards engagement with the intermediate shaft drive teeth. Then the mode change element may be formed with one or more engagement surfaces which are engageable with a cooperating engagement surface of a mode change linkage or a mode change knob so as to prevent rotation of the mode change element when the mode change linkage or knob engages the mode change element to draw it out of engagement with the intermediate shaft drive teeth against the biasing force of the spring member. Thus, in drilling only mode when the mode change linkage or knob engages the mode change member, the mode change member is prevented from rotating and slow hammering is prevented from occurring in drilling only mode.

The mode change element may be formed with at least one axially extending recess engageable with both sets of teeth and at least one axially extending recess with an axial stop surface formed in it wherein the axial recesses are formed in a radially inwardly directed surface of the mode change element.

BRIEF DESCRIPTION OF THE DRAWINGS

An embodiment of a hammer according to the present invention will now be described by way of example, with reference to the accompanying drawings in which:

FIG. 2A is a perspective view of the intermediate shaft sub-assembly of FIG. 1 with the mode change element in its forward hammering position with the mode change element shown partially cut away;

FIG. 2B is a longitudinal cross-section through FIG. 2A;

FIG. 3A is a perspective view of the intermediate shaft sub-assembly of FIG. 1 with the mode change element in its rearward non-hammering position with the mode change element shown partially cut away; and FIG. 3B is a longitudinal cross-section through FIG. 3A;

DESCRIPTION OF THE INVENTION

Figure 1:
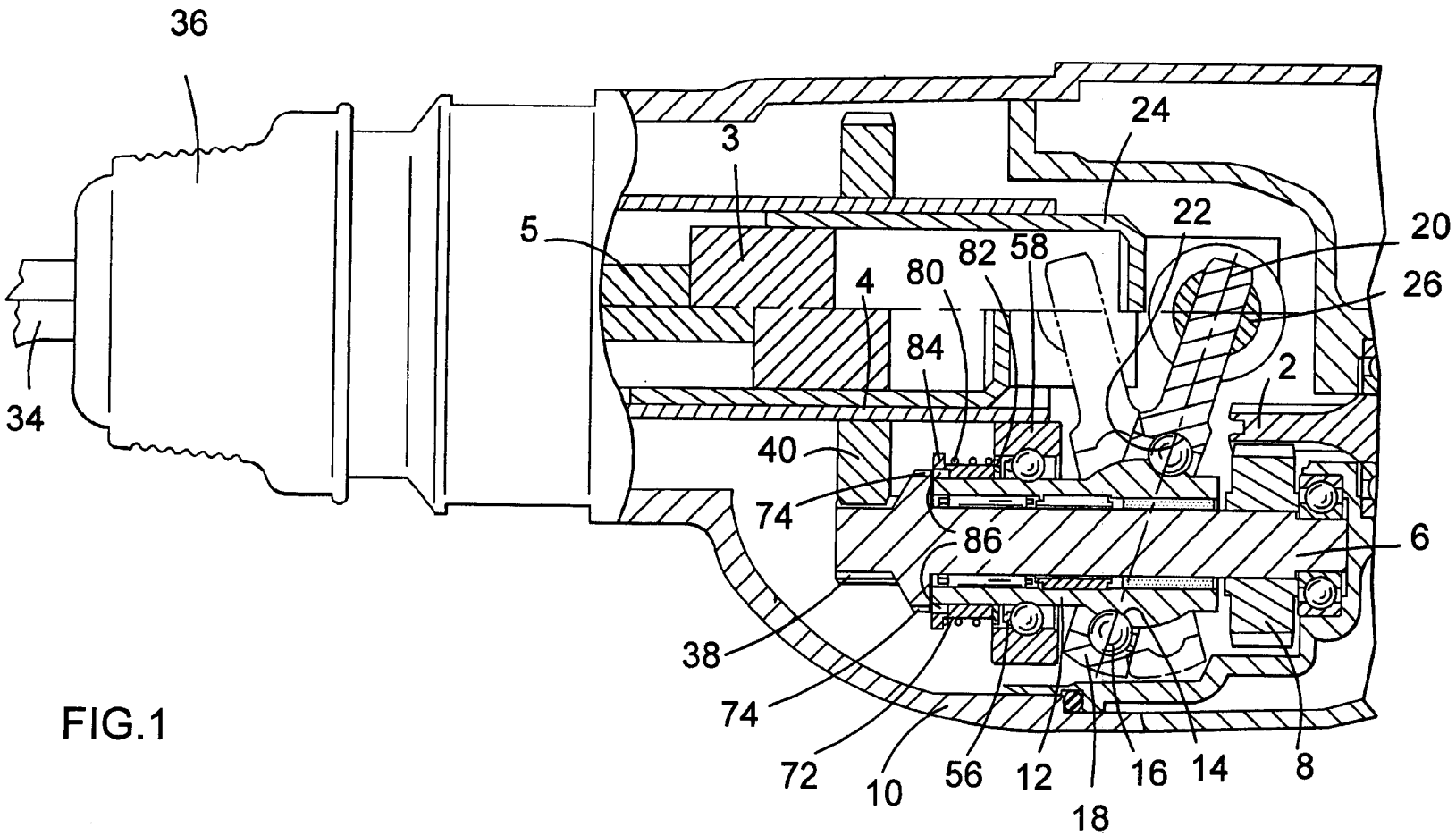
FIG. 1 is a partially cut away side cross-sectional elevation of the forward part of a rotary hammer according to the present invention.

The rotary hammer has a forward portion which is shown in FIG. 1 and a rearward portion incorporating a motor and a rear handle, in the conventional way. The handle may be of the pistol grip or D-handle type. The handle portion incorporates a trigger switch for actuating the electric motor, which motor is formed at the forward end of its armature shaft with a pinion (2). The pinion (2) of the motor rotatingly drives an intermediate shaft (6) via a gear (8) which gear is press fit onto the rearward end of the intermediate shaft (6). The intermediate shaft is located within a housing part (10) of the hammer, so that it can rotate about it longitudinal axis. In the FIG. 1 arrangement the longitudinal axis of the motor is parallel with the longitudinal axis of the hollow cylindrical spindle (4) of the hammer. Alternatively, the motor could be aligned with its axis, at an angle, for example perpendicular to the axis of the spindle (4), in which case a bevel pinion would be formed at the end of the armature shaft of the motor, to mesh with a bevel gear press fit on the intermediate shaft (6) replacing the gear (8).

A wobble sleeve (12) is mounted on the intermediate shaft (6) using needle bearings, so that it can rotate with respect to the intermediate shaft. The wobble sleeve (12) carries the inner race (14) for the ball bearings (16) of a wobble ring (18) from which extends a wobble pin (20). The balls are mounted between the inner race (14) and an outer race (22) formed in the wobble ring (18). Thus, as the wobble sleeve (12) rotates the end of the wobble pin (20) remote from the wobble ring (18) is caused to reciprocate, in order to reciprocatingly drive a hollow cylindrical piston (24). The most rearward position of the wobble pin (20) is shown cross-hatched in FIG. 1 and the most forward position of the wobble pin (20) is shown unshaded in FIG. 1. The end of the wobble pin reciprocatingly drives the piston (24) via a trunnion pin arrangement (26), as is well known in the art.

The hollow cylindrical piston (24) is slideably located within the hollow cylindrical spindle (4). A ram (3) is slideably mounted within the hollow cylindrical piston and an O-ring seal is mounted around the ram so as to seal between the periphery of the ram and the internal surface of the piston. During normal operation of the hammer, a closed air cushion is formed between the interior of the piston and the rearward face of the ram and so the ram is reciprocatingly driven by the piston via the closed air cushion. During normal operation of the hammer the ram repeatedly impacts a beatpiece (5), which beatpiece is mounted within the spindle so as to be able to undergo limited reciprocation. The beatpiece transfers impacts from the ram to a tool or bit (34) mounted within a forward tool holder portion of the spindle by a tool holder arrangement (36), for example an SDS-type tool holder. The tool or bit (34) is releasably locked within the tool holder portion of the spindle so as to be able to reciprocate within the tool holder portion of the spindle by a limited amount. In FIG. 1, the ram and beatpiece are shown in their idle mode position in the top half of FIG. 1 and in their operating position in the bottom pan of FIG. 1.

The spindle (4) which is rotatingly mounted within the hammer housing (10) can be rotatingly driven by the intermediate shaft (6), as described below. Thus, as well as or instead of reciprocating, the tool or bit (34) can be rotatingly driven because it is non-rotatably mounted within the spindle (4) by the tool holder arrangement (36). Thus, the hammer may have three modes, a drilling only mode in which no hammering occurs and the spindle is rotatingly driven; a hammer drilling mode in which hammering occurs and the spindle is rotatingly driven and a chisel or hammer only mode in which hammering occurs but there is no rotary drive to the spindle and in which the spindle is generally locked against rotation.

The intermediate shaft (6) is formed at its forward end with a pinion (38) which is selectively engageable with a spindle drive gear (40). The spindle drive gear (40) rotationally drives the spindle (4), optionally via a clutch arrangement, as is well known in the art. The spindle drive gear (40) can be moved axially forwardly on the spindle (4) in order to disengage the intermediate shaft pinion (38). Thus, with the spindle drive gear (40) in a forward position, no rotary drive is transmitted to the spindle (4) and with the spindle drive gear (40) in a rearward position rotary drive is transmitted from the intermediate shaft (6) to the spindle (4) via the intermediate shaft pinion (38) and the spindle drive gear (40).

A mode change element in the form of a ring (72) is non-rotatably but axially slideably mounted on the forward portion of the wobble sleeve (12), co-axially with the intermediate shaft (6). The mode change ring is mounted on the wobble sleeve via driven teeth, which take the form of two opposing splines (76) formed on the outer surface of the forward end of the wobble sleeve (12). The driven teeth or splines engage in a pair of cooperating recesses which are formed in the radially inward facing surface of the mode change ring. The recesses extend axially from the forward to the rearward facing face of the mode change ring. The recesses of the mode change ring (72) are selectively engageable with an opposing pair of a set of drive teeth (74) formed on an increased outer diameter portion of the intermediate shaft (6). When the mode change ring (72) is in a rearward position, as shown in FIGS. 1, 3A and 3B no rotary drive is transmitted from the intermediate shaft (6) to the wobble sleeve (12) and so no hammering occurs. When the mode change ring (72) moves forwardly into a forward position, as shown in FIGS. 2A and 2B, the recesses in the mode change ring (72) engage an opposing pair of the set of drive teeth (74) formed on the intermediate shaft (6). In the forward position of the mode change ring (72) the recesses in the mode change ring straddle the intermediate shaft drive teeth (74) and the splines (76) on the wobble sleeve (12). Thus, in the forward position of the mode change ring (72) rotary drive is transmitted from the intermediate shaft (6) to the wobble sleeve (12) via the mode change ring (72) and hammering occurs.

The mode change ring (72) is biased forwardly, into engagement with the intermediate shaft drive teeth (74) by a helical spring (80) which extends around the forward end of the wobble sleeve (12). The spring (80) extends between a washer (82) located in front of a bearing cage (56) of a support bearing (58) for the intermediate shaft (6) and an annular flange (84) which extends radially outwardly of the forward end of the mode change ring (72).

The mode change ring (72) is operated on by a mode change knob (21). The mode change knob has an eccentric pin (23) which is engageable with the forward facing face of the mode change ring (72). The mode change knob (21) is rotatably mounted in the housing (10) and can be rotated by a user to change the position of the eccentric pin (23) to selectively actuate hammering. When a user locates the mode change knob in the drilling only mode position, the eccentric pin (23) of the mode change knob (21) engages the mode change ring (72) to pull the mode change ring rearwardly against the biasing force of the spring (80) into the rearward position of the mode change ring (72) shown in FIG. 3A. When a user locates the mode change knob (21) in a hammering drilling mode position or the chisel mode position the eccentric pin (23) of the mode change knob (21) no longer engages the mode change ring (72) to pull it rearwardly, as shown in FIG. 2A and the biasing force of the spring (80) biases the mode change ring into its forward position of FIGS. 2A and 2B and hammering occurs. The use of the spring (80) to bias the mode change ring (72) into its forward, hammering position, helps to simplify the structure of the mode change knob or other alternative mode change arrangement, as the mode change arrangement or knob has only to engage the mode change ring (72) in the drilling mode, and need only move the mode change ring (72) in one direction, ie. rearwardly. Alternatively, a mode change linkage can act between a mode change knob and the mode change ring (72), as is well known in the art.

On the change from a drilling only mode to a hammer drilling mode or to a chisel mode of the hammer, the mode change sleeve is moved forwardly from the position in FIGS. 1, 3A and 3B by the biasing force of the spring (80). Sometimes, the recesses in the mode change ring (72) will not be aligned with the drive teeth (74) on the intermediate shaft (6) and so the spring (80) will not be able to move the mode change ring (72) into its forward position. However, as soon as the intermediate shaft (6) is rotatingly driven by the motor, the recesses (76) in the mode change ring (72) come into alignment with the intermediate shaft drive teeth (74) and the spring (80) moves the mode change (72) into its forward position of FIGS. 2A and 2B in which the recesses straddle the intermediate shaft drive teeth (74) and the splines (76) on the wobble sleeve (12) and hammering occurs. Thus, the spring (80) facilitates the synchronization of the teeth (76) and recesses on the start up of hammering.

During hammering, the wobble sleeve (12), mode change ring (72) and spring (80) rotate with the intermediate shaft (6). The ball bearing cage (56) will rotate at a slower speed than the wobble sleeve (12). The washer (82) protects the cage (56), which latter is a plastic part, from the end of the metal spring (80). In the absence of the washer (82) the rearward end of the spring (80) would cause damage to the bearing cage (56).

Four forwardly facing pockets (86) are located two between each recess in the mode change ring (72), on the radially inwardly facing surface of the mode change ring. The pockets are formed as axially extending recesses formed in the radially inward facing face of the mode change ring (72), which are open at a forward end of the mode change ring and are closed at a rearward end of the recess by an end surface. The intermediate shaft (6) is formed with six driving teeth (74) which correspond to the two recesses and the four pockets (86) of the mode change ring (72). When the mode change ring (72) moves to its forward position in which the recesses engage two opposing teeth of the set of driving teeth (74), the pockets (86) engage the remaining driving teeth. The rearward end faces of the pockets (86) abut the rearward facing face of the driving teeth (74), as shown in FIGS. 2A and 2B, to prevent any further forward movement of the mode change ring (72). Previously a stop ring would have been provided on the intermediate shaft to limit the forward movement of the mode change ring (72).

The mode change ring (72) can also prevent slow hammering from occurring in drilling only mode of the hammer. Due to friction in the needle bearings which are used to rotatably mount the wobble sleeve (12) on the intermediate shaft (6), when the hammer is in drilling only mode, the wobble sleeve will rotate slowly, despite the mode change ring (72) being in its rearward position. This causes slow hammering to occur. To prevent this the mode change ring (72) is formed on the forward face of its flange with a set of radially extending recesses (88). In drilling mode, the eccentric pin (23) of the mode change knob (21), or a projection on a mode change linkage, engages the forward face of the mode change ring (72) to pull the mode change ring (72) rearwardly against the force of the spring (80). As soon as the wobble sleeve (12) and thus the mode change ring (72) start to rotate slowly, the eccentric pin (23) or other projection engages one of the recesses (88) in the mode change ring (72) (as shown in FIG. 3A) to prevent further rotation of the mode change ring (72) and thus the wobble sleeve (12). In this way slow hammering is stopped.

The invention claimed is:

1. An electrically powered hammer comprising:

a hammering mechanism;

a rotatingly driven intermediate shaft including a set of drive teeth;

a wobble drive arrangement for reciprocatingly driving the hammering mechanism, which wobble drive arrangement includes a wobble sleeve mounted on the intermediate shaft and the wobble sleeve includes a set of driven teeth;

a mode change element selectively engageable, by movement along the intermediate shaft, such that when the mode change element is engaged with the drive teeth and the driven teeth then rotary drive is transmitted from the intermediate shaft to the wobble sleeve; the mode change element is formed integrally with an axial stop surface and the axial stop surface is engageable with a cooperating end stop surface formed integrally with one of the intermediate shaft and the wobble sleeve to limit the movement of the mode change element along the intermediate shaft; the mode change element including an engagement surface; and a mode change actuator including a cooperating engagement surface, and the mode change actuator is user selectable between a first position wherein the mode change element is engaged with both the drive teeth and the driven teeth and a second position wherein the mode change element is not engaged with the drive teeth, and when in the second position the cooprating engagement surface of the mode change actuator engages the engagement surface of the mode change element to prevent friction induced rotation of the wobble drive arrangement.

2. A hammer according to claim 1 wherein the axial stop surface engages with the cooperating end stop surface when the mode change element engages both sets of teeth.

3. A hammer according to claim 2 wherein the mode change element is moved in a first direction along the intermediate shaft to engage both the drive teeth and the driven teeth, and the cooperation of the axial stop surface and cooperating end stop surface limits the movement of the mode change element further along the intermediate shaft in the first direction.

4. A hammer according to claim 1 wherein the cooperating end stop surface is formed by one or more end faces of one of the set of drive teeth and the set of driven teeth.

5. A hammer according to claim 1 wherein the axial stop surface is formed by an end surface of one or more recesses, which recesses extend axially with respect to the longitudinal axis of the intermediate shaft and are formed in a face of the mode change element facing towards the intermediate shaft.

6. A hammer according to claim 1 wherein the mode change element is non-rotatably and axially slideable mounted on one of the set of the drive teeth and the set of the driven teeth.

7. A hammer according to claim 1 and further including a spring member which biases the mode change element into engagement with both the set of drive teeth and the set of driven teeth.

8. A hammer according to claim 7 wherein the spring member extends between a flange formed on the mode change element and a bearing ring for rotatably supporting the intermediate shaft in the housing.

9. A hammer according to claim 8 wherein the bearing ring forms an outer race for a set of balls which run between the outer race and an inner race formed in an external surface of the wobble sleeve.

10. A hammer according to claim 1 and further including a housing and a hollow cylindrical spindle mounted within the housing.

11. A hammer according to claim 1 wherein the mode change element is formed as at least a portion of a ring and is mounted co-axially with the intermediate shaft.

12. A hammer according to claim 1 wherein the mode change element is non-rotatably and axially slideably mounted on the intermediate shaft drive teeth.

13. A hammer according to claim 12 wherein the axial stop surface of the mode change element engages with a cooperating end stop formed on the wobble sleeve.

14. A hammer according to claim 1 wherein the mode change element is non-rotatably and axially slideably mounted on the wobble sleeve driven teeth.

15. A hammer according to claim 14 wherein the axial stop surface of the mode change element engages with a cooperating end stop surface formed on the intermediate shaft.

16. A hammer according to claim 14 and further including a spring member which biases the mode change element towards engagement with the intermediate shaft drive teeth.

17. A hammer according to claim 1 wherein the mode change element includes at least one axially extending recess formed in a radially inwardly directed surface of the mode change element, and an axial stop surface formed in the axially extending recess, and wherein the axially extending recess is engageable with both the set of drive teeth and the set of driven teeth.

18. A hammer according to claim 1 and further including a tool holder assembly, for holding a tool or bit so as to enable limited reciprocation of the tool or bit within the tool holder.

* * * * *